US006767148B2

(12) United States Patent
Murata

(10) Patent No.: US 6,767,148 B2
(45) Date of Patent: Jul. 27, 2004

(54) OPTICAL DISK ADAPTER FOR OPTICAL DISK LABEL PRINTERS

(75) Inventor: Masato Murata, Osaka (JP)

(73) Assignee: Orient Instrument Computer Co., Ltd., Osaka (JP)

( * ) Notice: Subject to any disclaimer, the term of this patent is extended or adjusted under 35 U.S.C. 154(b) by 47 days.

(21) Appl. No.: 10/073,276

(22) Filed: Feb. 13, 2002

(65) Prior Publication Data

US 2002/0110399 A1 Aug. 15, 2002

(30) Foreign Application Priority Data

Feb. 13, 2001 (JP) ..... 2001-035873

(51) Int. Cl.[7] ..... B41J 13/00

(52) U.S. Cl. ..... 400/578; 400/719; 400/48; 400/23; 101/35; 369/77.1; 369/289

(58) Field of Search ..... 369/77.1, 289; 101/35, 36, 37, 578; 400/615.1, 719, 23, 48

(56) References Cited

U.S. PATENT DOCUMENTS 5,097,460 A * 3/1992 Camps et al. ..... 369/77.1
5,208,802 A * 5/1993 Suzuki et al. ..... 369/289
5,682,991 A * 11/1997 Lammerant et al. ..... 206/308.1
6,469,971 B1 * 10/2002 Sato et al. ..... 369/77.1
6,574,179 B2 * 6/2003 Kaneko et al. ..... 369/77.1
6,580,444 B1 * 6/2003 Drynkin et al. ..... 347/171

FOREIGN PATENT DOCUMENTS

| | | |
|---|---|---|
| JP | 63228455 A | 9/1988 |
| JP | 01213858 A | 8/1989 |
| JP | 6-68167 | 9/1994 |
| JP | 10138667 A | 5/1998 |
| JP | 2000-11573 | 1/2000 |
| JP | 200132874 A | 12/2000 |
| WO | PA-02017/P CT | 4/2002 |

* cited by examiner

*Primary Examiner*—Andrew H. Hirshfeld
*Assistant Examiner*—Dave A. Ghatt
(74) *Attorney, Agent, or Firm*—Rothwell, Figg, Ernst & Manbeck; Stephen B. Parker, Esq.

(57) ABSTRACT

A disk adapter A is equipped with first and second adapter halves 1 and 2 to be detachably disposed in a disk-placing dented portion 54 provided in a disk tray 53 of a label printer 51. One of the adapter halves 1 and 2 is movable relative to the other thereof in accordance with a movement of a disk pushing member 55 provided in the disk tray 53. When the disk tray 53 is inserted into a printer main body 52, the aforementioned one of the adapter halves is moved in a direction that the one of the adapter halves approaches the other thereof by the disk pushing member 55, whereby the optical disk D is held by and between both the adapter halves 1 and 2.

25 Claims, 16 Drawing Sheets

OPTICAL DISK ADAPTER FOR OPTICAL DISK LABEL PRINTERS

BACKGROUND OF THE INVENTION

1. Field of the Invention

The present invention relates to an optical disk adapter to be attached to an optical disk label printer, and more particularly, to an optical disk adapter which is detachably attached to an optical disk label printer so that the printer can perform the printing on an optical disk smaller than and/or different from an optical disk to which the printer can be originally applied.

2. Description of Related Art

Among optical disks which have recently became indispensable information recording medium, the so-called compact disk is widely used. In this specification, the language of "CD" is used as a general term of a CD-DA (for musical use), a CD-ROM, a CD-R, a CD-RW and the like.

For example, a CD-ROM as a read only memory compact disk is manufactured by: creating the so-called metal master; creating a metal mother as a spare of the metal master; forming a stamper; forming by using the stamper; creating a reflective layer; creating a protective layer; and performing label printing.

The aforementioned manufacturing process is advantageous in manufacturing cost in cases where a large number of CD-ROMs are manufactured at once. However, in cases where several tens of or several hundreds of CD-ROMs are manufactured, it becomes rather expensive.

Therefore, in cases where a relatively small number of CD-ROMs are manufactured a method of copying the information stored in the personal computer to a raw CD-R (compact disk recordable) in employed. In order to perform the label printing to the CD-R to which the information was copied a label printer is used.

This label printer is connected to the aforementioned copying machine. This copying machine is equipped with a hand arm, and performs the following operations continuously and automatically: transferring a CD-R to a copying machine: taking out of the recorded CD-R (which is a substantial CD-ROM) from the copying machine; transferring the recorded CD-R to the label printer; taking out of the printed CD-R from the printer, and stacking the taken-out CD-Rs (hereinafter this machine is referred to as "automatic machine").

The schematic structure of the label printer will be explained with referring to FIGS. 16 and 17.

This label printer 51 is equipped with a printer main body 52 and a disk tray 53 provided to the printer main body 52 so that the disk tray 53 can be ejected from and inserted into the printer main body 52. In the printer main body 52, an ink head, etc. (not shown) are provided. FIG. 16 is a plane view showing the state where the disk tray 53 is ejected from the printer main body 52. FIG. 17 is a plane view showing the state where the disk tray 53 with the disk D disposed thereon is stored in the printer main body 52.

The disk tray 53 is provided with a disk-placing dented portion 54 at the longitudinal central portion thereof, i.e., at around the central portion thereof in the front-and-back direction of the printer main body 52. The disk-placing dented portion 54 has a size capable of accepting a 12 cm-CD with a little space therearound. When the disk tray 53 with the disk D placed in the disk-placing dented portion 54 is inserted into the printer main body 52, the disk pushing member 55 provided to the disk tray 53 moves forward. As a result, the tip protrusion 55*a* of the disk pushing member 55 moves forward along the guiding slot 56 formed at the back end portion of the disk-placing dented portion 54, and urges the disk D forward. Accordingly, the front peripheral portion of the disk D is pressed against the front inner end of the disk-placing dented portion 54. More concretely, the front peripheral portion of the disk D is pressed against the lower portions of a pair of right and left ledges 60 and 60 formed at the front end portion o0f the disk-placing dented portion 54 in such a manner that the front peripheral portion of the disk D is located below the ledges.

Accordingly, the disk D is immovably held in the disk-placing dented portion 54, whereby printing of the disk D can be correctly performed by an ink head in the printer main body 52. After the completion of the printing, the disk tray 53 is ejected from the printer main body 52 automatically. In the case of the aforementioned automatic machine, the disk D is automatically picked out from the ejected disk tray 53 by a hand arm. In the case of manual operation, the disk D can be taken out by pushing up the disk D by a finger upwardly inserted in the finger insertion aperture 59 formed in the central portion of the disk-placing dented portion 54.

In FIG. 16, the reference numeral 58 denotes a sensor aperture formed in the printer main body 52 for discriminating whether a disk D is loaded at the time of inserting the disk tray 53. The reference numeral 57 denotes a die-releasing hole formed at the time of forming the ledge 60.

By the way, the aforementioned label printer 51 is designed for performing label printing of a 12 cm-CD. Accordingly, the label printer 51 cannot be used for performing label printing of an 8 cm-CD smaller than the 12 cm-CD or a non-circular CD including a card shaped CD.

Of course, it is possible to use a disk adapter as disclosed by Japanese Unexamined Laid-open Patent Publication No. 2000-11573 for performing label printing of the aforementioned CDs. However, in order to attach the aforementioned CD to such a disk adapter, it is required to operate engaging means such as engaging ledges provided to the disk adapter. Although the operation itself is generally simple, in cases where dozens of or hundreds of label printing have to be carried out, the attaching and detaching operation should be repeated, resulting in nuisance jobs. Furthermore, such an adapter cannot be used in an automatic machine that automatically performs from copying of CDs to label printing thereof.

SUMMARY OF THE INVENTION

It is an object of the present invention to provide a disk adapter for label printers which can simply and assuredly perform attaching and detaching operation of an optical disk smaller than a predetermined optical disk for which the label printer is designed or an optical disk having a configuration different from that of the predetermined optical disk. It is another object of the present invention to provide a disk adapter for label printers capable of automatically holding and releasing an optical disk when a disk tray is inserted into and ejected from a printer main body.

According to the present invention, a disk adapter to be attached to an optical disk label printer, wherein the optical disk label printer is equipped with a disk tray with a disk-placing dented portion, the disk tray being mounted to a printer main body in such a manner that the disk tray can be ejected from and inserted into the printer main body, and a disk pushing member for holding an optical disk in the disk-placing dented portion, the disk pushing member being movably provided to the disk tray, the disk adapter includes:

a first adapter half to be detachably placed in a front portion of the disk-placing dented portion; and a second adapter half to be detachably placed in a rear portion of the disk-placing dented portion, wherein one of the adapter halves is movable relative to the other adapter half in accordance with a movement of the disk pushing member, wherein, in a state where the disk tray is ejected from the printer main body, the one of the adapter halves is moved by the disk pushing member in a direction that the one of the adapter halves goes away from the other adapter half, whereby a disk-disposing space is formed between the adapter halves, and wherein, in a state where the disk tray is inserted into the printer main body, the one of adapter halves is moved by the disk pushing member in a direction that the one of adapter halves approaches the other adapter half whereby the optical disk is held by and between the adapter halves.

According to the present inventions in a state where the disk tray is inserted into the printer main body, since one of the adapter halves is moved by the disk pushing member so as to approach the other adapter half to hold the optical disk by and between both the adapter halves, an unexpected movement of the disk does not occur at the time of the label printing. Accordingly, printing to a predetermined printing position can be performed assuredly. Furthermore, when the disk tray is inserted into the printer main body with a disk disposed in the disk-disposing space between the adapter halves, the disk is automatically held. Accordingly, it becomes unnecessary to perform operation for fixing the disk to and releasing it from a disk adapter required in a conventional adapter.

The first adapter half and the second adapter half may be pivoted at one side thereof so that the second adapter half can be pivoted on the one side as a fulcrum in accordance with a forward/backward movement of the disk pushing member. In this case, when the second adapter half pivots on the side portion as a fulcrum in accordance with the forward/backward movement of the disk pushing member, the disk is held by and between the adapters halves or released from the adapter halves.

Alternatively, the second adapter half may be moved in a longitudinal direction of the disk tray in accordance with the forward/backward movement of the disk pushing member. In this case, when the second adapter half is moved in a longitudinal direction of the disk tray in accordance with the forward/backward movement of the disk pushing member, the disk is held by and between the adapters halves or released from the adapter halves.

It is preferable that the first adapter half is equipped with fixing members for detachably fixing the first adapter half in the disk-placing dented portion. In this case, since it is only required to move one of the adapter halves, a disk adapter for optical disk label printers excellent in operability can be provided.

As the aforementioned fixing member, a downwardly protruded member can be used suitably. In this case, the fixing member can be formed at the time of manufacturing the first adapter half.

It is preferable that the second adapter half is equipped with a connecting portion for connecting the second adapter half to the disk pushing member. In this case, since the second adapter half and the disk pushing member are connected each other by the connecting portion, the second adapter half is moved relative to the first adapter half in accordance with the forward/backward movement of the disk pushing member.

The connecting portion of the second adapter half may be magnetically connected to the disk pushing member. In this case, the second adapter half is moved relative to the first adapter half in accordance with the forward/backward movement of the disk pushing member, and the operation for connecting the second adapter half to the disk pushing member and disconnecting the second adapter half from the disk pushing member can be performed easily and assuredly, resulting in enhanced operability.

The first adapter half and the second adapter half may be integrally connected via an elastic connecting member. In this case, in a state where the disk tray is ejected from the printer main body, one of the adapter halves is moved so as to go away from the other adapter half due to the backward movement of the disk pushing member and the elastic resiliency of the connecting member. Accordingly, an optical disk-disposing space can be secured easily and assuredly between the adapter halves.

It is preferable that the first adapter half and the second adapter half have a slanted inner periphery, respectively. In this case, since a disk is guided by the slanted inner periphery at the time of disposing the disk in the disk-disposing space between the first and second adapters, the disposing can be carried out easily and assuredly. Especially, in cases where a disk is disposed in the disk-disposing space with a machine such as a hand arm, a preferable disk adapter for optical disk label printers can be provided.

In cases where the disk-disposing space is set to have a configuration and a size corresponding to those of a card-shaped optical disk, it becomes possible to perform printing to the card-shaped optical disk.

The disk adapter according to the present invention is not limited to the disk adapter for the card-shaped disk, and can be adapted not only to an 8 cm-CD but also to various non-standard size/shape CD other than the card-shaped CD by changing the configuration of the first adapter half, the second adapter half and/or the disk-disposing space.

Furthermore, a thin member rich in elasticity may be attached to the disk peripheral contact portion of the adapter halves. In this case, a disk can be held by and between the adapter halves more assuredly.

Other objects and the features will be apparent from the following detailed description of the present invention with reference to the attached drawings.

BRIEF DESCRIPTION OF THE DRAWINGS

The present invention will be more fully described and understood from the following description, taken with the append drawings, in which.

DETAILED DESCRIPTION OF THE PREFERRED EMBODIMENTS

The present invention will be explained based on the following embodiments.

FIGS. 1 to 5 show a disk adapter according to the first embodiment of the present invention.

Figure 1:
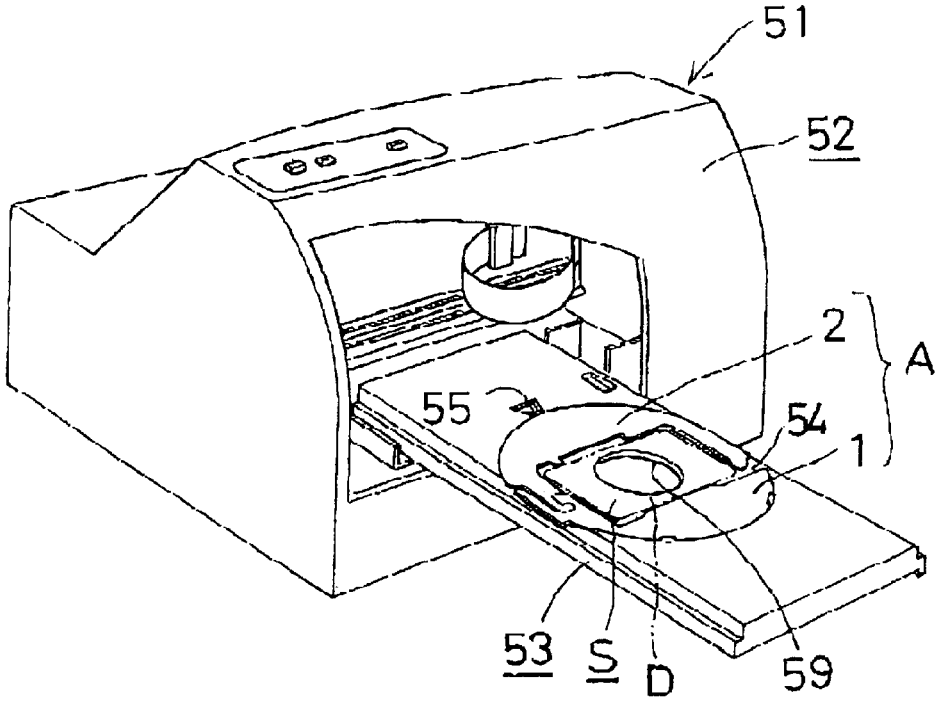
FIG. 1 is a perspective view showing the state where the disk adapter according to the first embodiment of the present invention is disposed on a disk tray of a label printer.

FIG. 1 shows the state where the aforementioned disk adapter A is attached to a disk tray 53 of a label printer 51. This label printer 51 is designed for performing label printing to a circular disk with a diameter of 12 cm.

The disk adapter A according to this embodiment is used when label printing is performed to a card-shaped compact disk D using the aforementioned label printer 51.

Figure 2A:
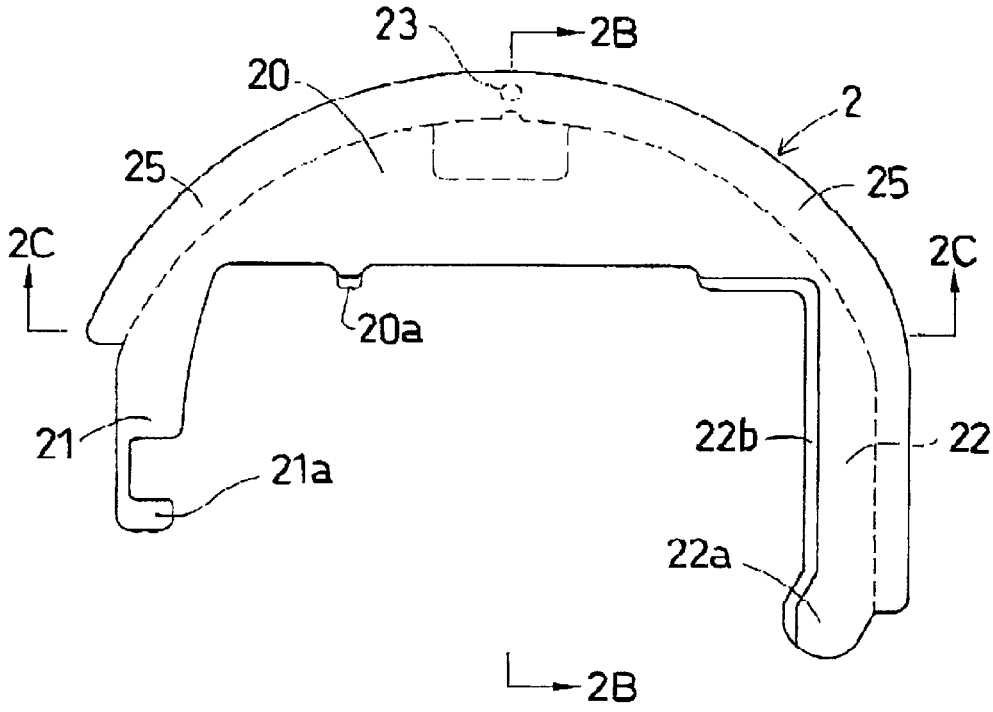
FIG. 2A it a plane view showing the second adapter half disk adapter.
Figure 3A:
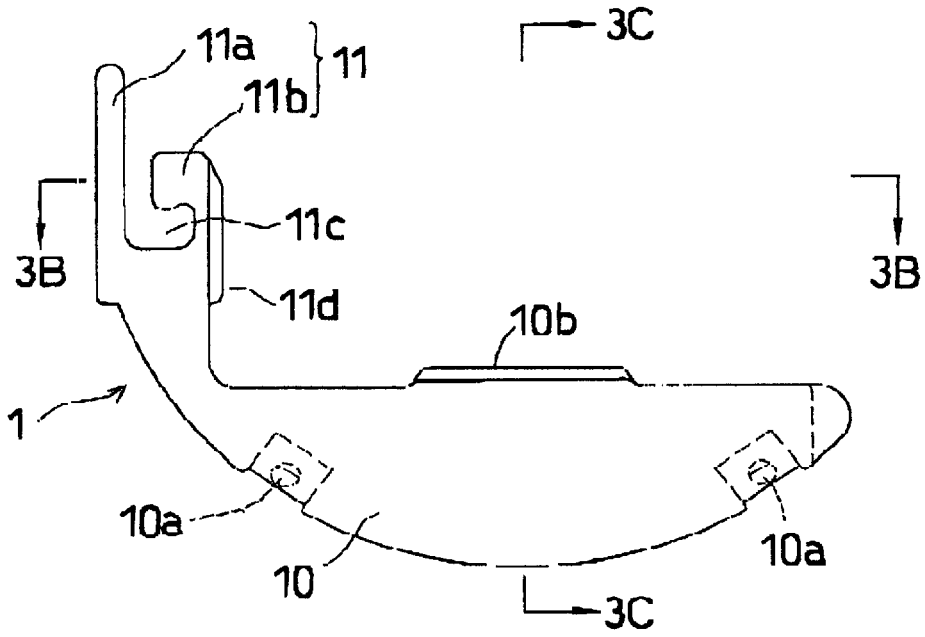
FIG. 3A is a plane view showing the first adapter half of the disk adapter.

This disk adapter A consists of a generally L-shaped first adapter half 1 as shown in FIG. 3A and a generally C-shaped second adapter half 2 as shown in FIG. 2A.

Figure 3B:
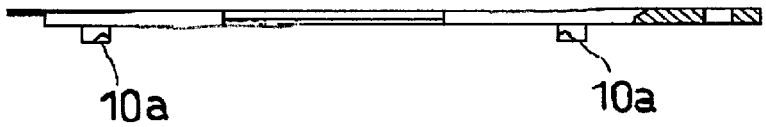
FIG. 3B is a cross-sectional view taken along the line 3B—3B in FIG. 3A.
Figure 3C:
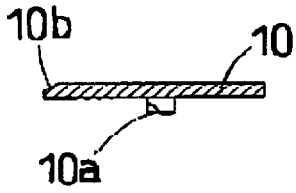
FIG. 3C is a cross-sectional view taken along the line 3C—3C in FIG. 3A.

The aforementioned first adapter half 1 is to be detachably disposed at the front-end portion in the disk-placing dented portion 54 of the disk tray 53. As shown in FIG. 3A, this first adapter half 1 includes a main body portion 10 having a configuration corresponding to the inner peripheral edge of the disk-placing dented portion 54 formed in the disk try 53 of the disk printer 51 and a connecting portion 11 extending from one side portion of the main body portion 10. The connecting portion 11 has an outside longer leg portion 11*a* and an inside shorter leg portion 11*b*. Formed between the leg portions 11*a* and 11*b* is a generally L-shaped engaging cutout portion 11*c*. Furthermore, as shown in FIG. 3B and FIG. 3C, two engaging protrusions 10*a* and 10*a* are downwardly protruded from the lower surface of the main body portion 10. These engaging protrusions 10*a* and 10*a* correspond to the die-releasing hole 57 and 57 provided in the disk-placing dented portion 54 of the disk tray 53, respectively.

Figure 4:
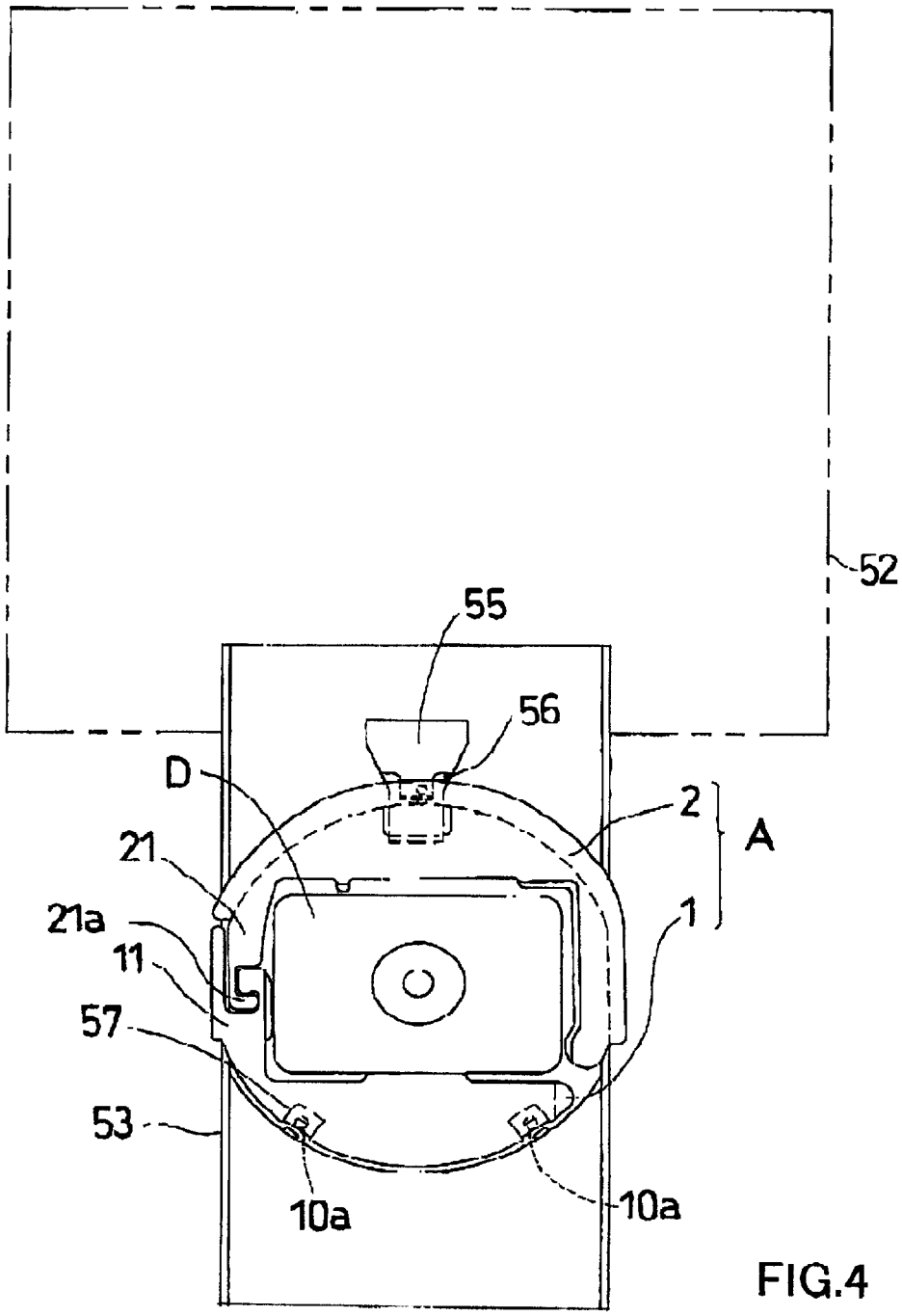
FIG. 4 is a plane view showing the disk tray ejected from the printer main body and the disk adapter disposed on the disk tray according to the first embodiment.
Figure 5:
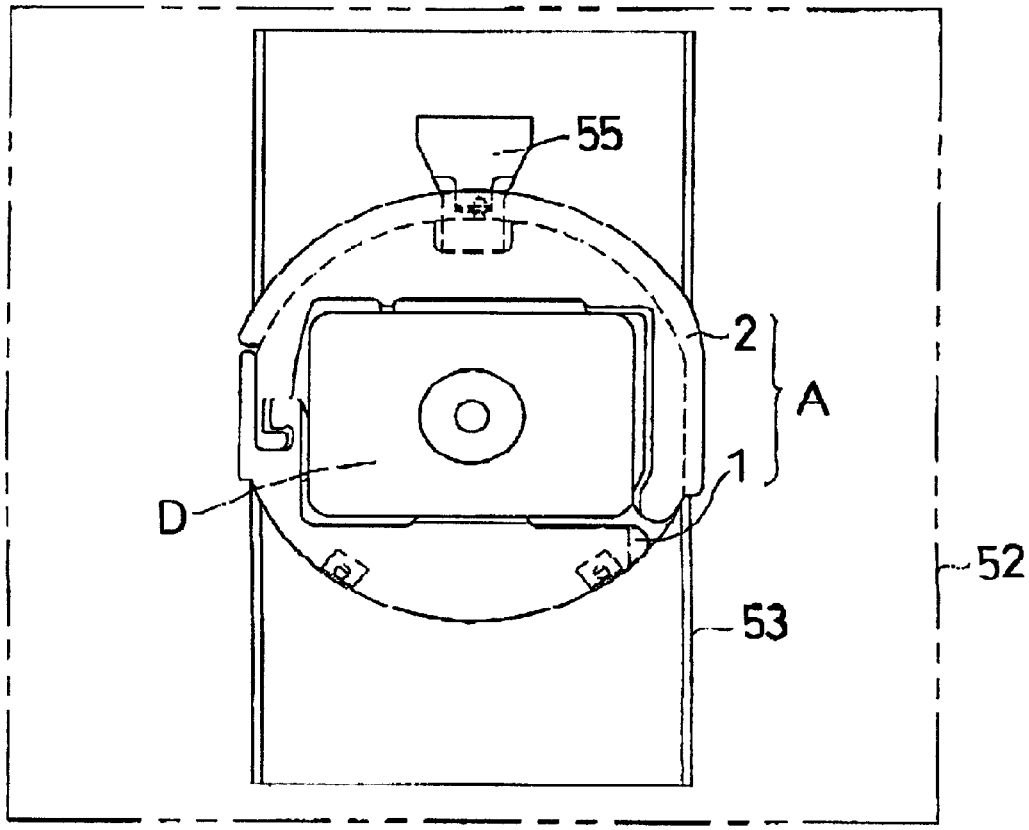
FIG. 5 is a plane view showing the disk tray inserted in the printer main body and the disk adapter disposed on the disk tray according to the first embodiment.

As shown in FIG. 4, this first adapter half 1 is placed in the disk-placing dented portion 54 of the disk tray 53 so as to fit the front inner peripheral edge of the dented portion 54. In this state, the engaging protrusions 10*a* and 10*a* are engaged with the die-releasing holes 57 and 57, so that the first adapter half 1 is detachably fixed in the front-end portion of the disk-placing dented portion 54.

Figure 2B:
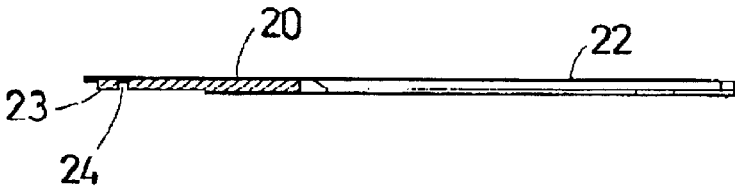
FIG. 2B is a cross-sectional taken along the line 2B—2B in FIG. 2A
Figure 2C:
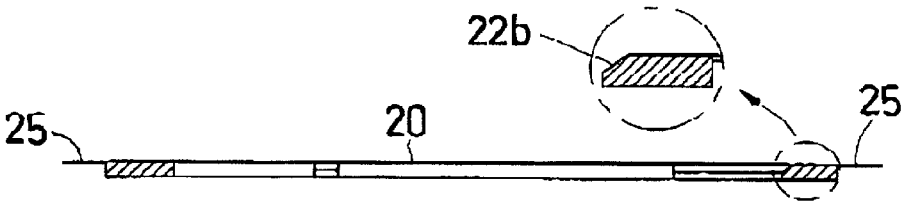
FIG. 2C is a cross-sectional view taken along the line 2C—2C in FIG. 2A.

On the other hand, the second adapter half 2 shown in FIG. 2A is to be detachably placed at the rear end portion in the disk-placing dented portion 54 of the disk tray 53. This second adapter half 2 consists of a main body portion 20 having an external peripheral edge corresponding to the inner peripheral edge of the disk-placing dented portion 54, a connecting portion 21 extending from one side portion of the main body portion 20 and an arm portion 22 extending in parallel with the connecting portion 21 from the other side portion of the main body portion 20. The connecting portion 21 includes an L-shaped engaging portion 21*a* corresponding to the L-shaped cutout portion 11*c* of the first adapter half 1. The arm portion 22 is longer than the connecting portion 21 and has an inwardly bent pushing portion 22*a* at its tip end. Furthermore, at the peripheral edge of the main body portion 20 and the arm portion 22, an outwardly protruded edge 25 is formed. Furthermore, in the central portion of the lower surface of the outwardly protruded edge 25 of the main body portion 20, as shown in FIGS. 2B and 2C, an engaging protrusion 23 is formed. Thus, an engaging protrusion 55*a* provided at the disk pushing member 55 of the disk tray 53 is engaged with the gap 24 between the engaging protrusion 23 and the main body portion 20.

Thus, as shown in FIG. 4, this second adapter half 2 is placed in the disk-placing dented portion 54 of the disk tray 53 so as to fit the rear end peripheral portion in the disk-placing dented portion 54. In this state, the engaging protrusion 55*a* of the disk pushing member 55 engages with the gap 24, and the L-shaped engaging portion 21*a* of the connecting portion 21 engages with the L-shaped engaging cutout portion 11*c* of the first adapter half 1.

Thus, the first adapter half 1 and the second adapter half 2 are pivoted at the connecting portions 11 and 21 as a fulcrum so that the second adapter half 2 can be pivoted in the directions of coming close to and going away from the first adapter half 1 in a predetermined range.

Figure 16:
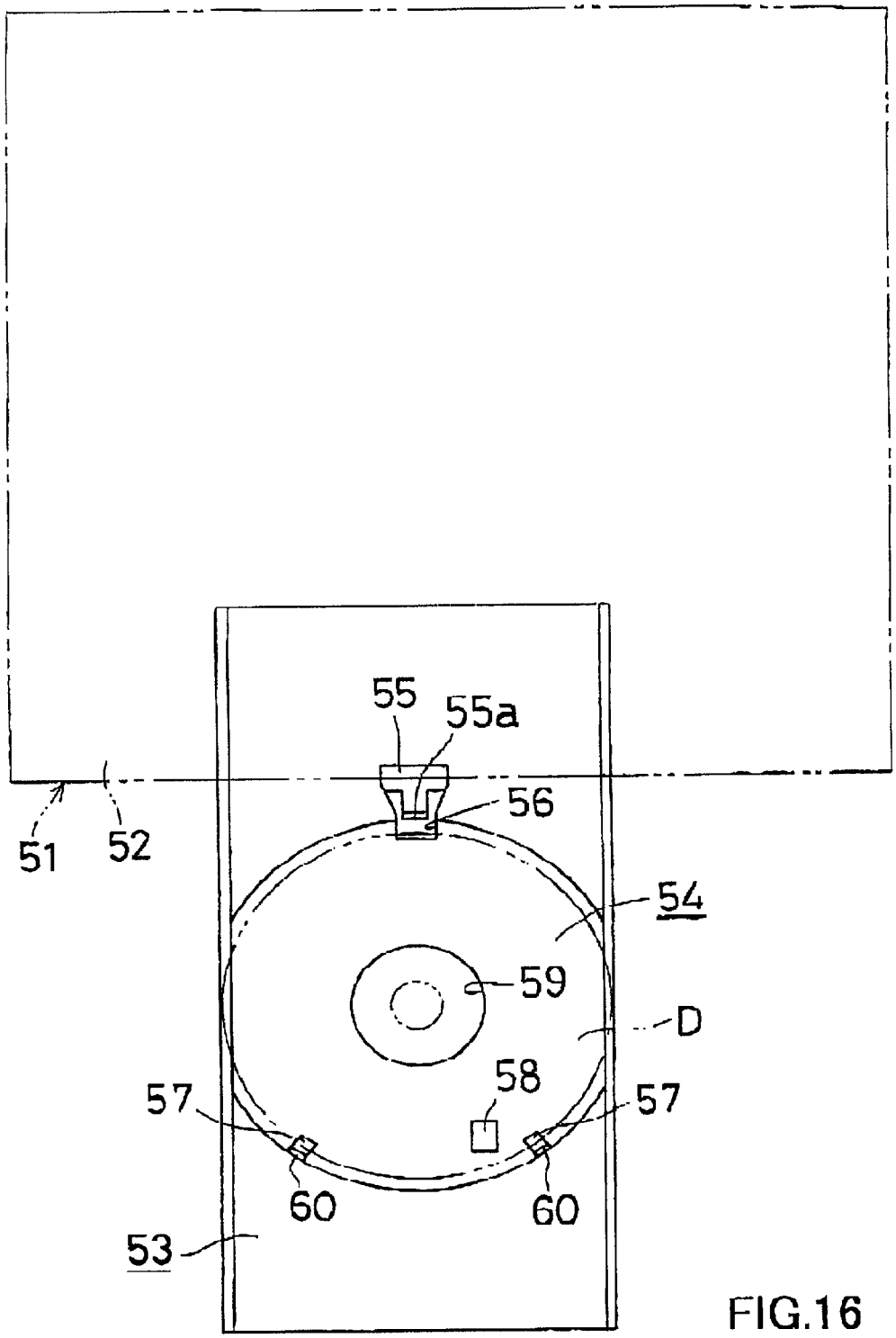
FIG. 16 is a schematic explanatory view showing the state where the disk tray is ejected from the printer main body.
Figure 17:
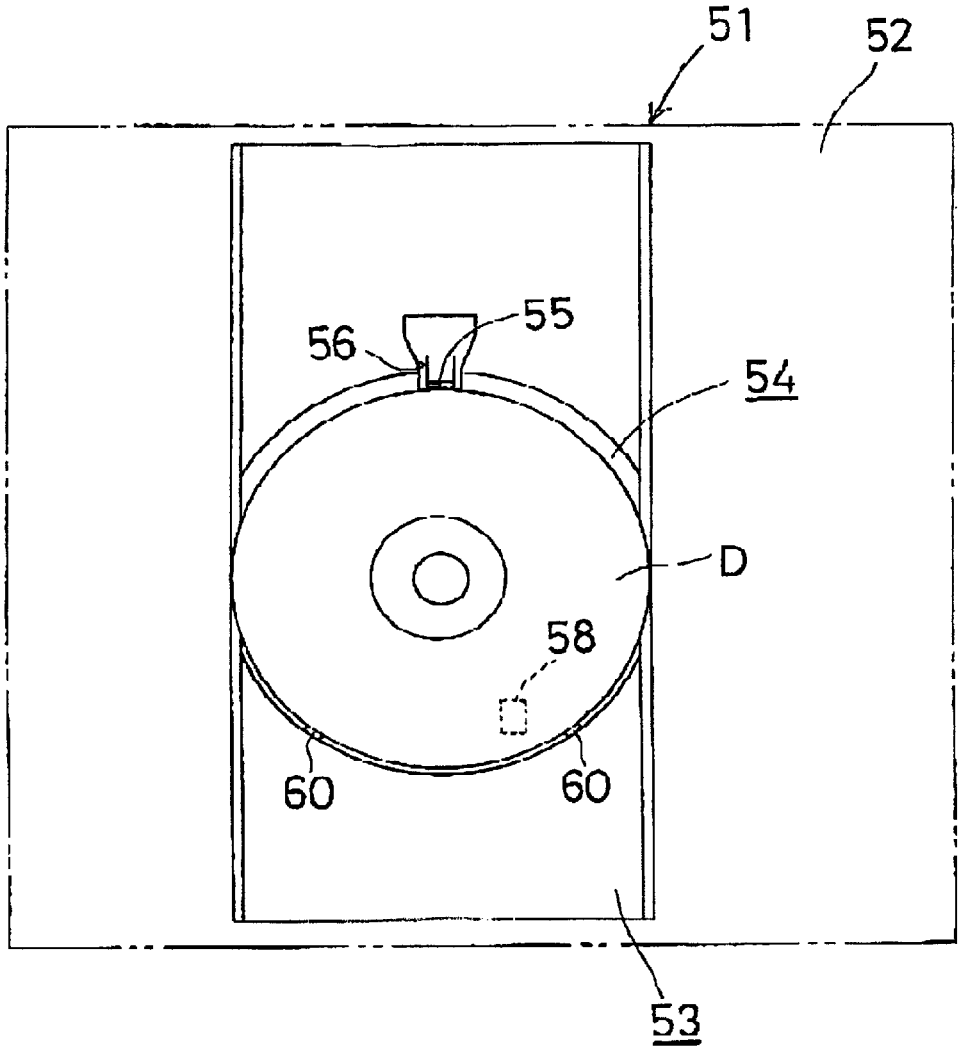
FIG. 17 is a schematic explanatory view showing the state where the disk tray is inserted in the printer main body.

By the way, the disk pushing member 55 provided at the disk tray 53 is slidably mounted in the guiding slot 56 formed in the disk tray 53. In the state where the disk tray 53 is ejected from the printer main body 52 as shown in FIG. 16, the aforementioned disk pushing member 55 is moved backward, so that the disk pushing member 55 goes out of the disk-placing dented portion 54. On the other hand, in the state where the disk tray 53 is inserted in the printer main body 52 as shown in FIG. 17, the disk pushing member 55 is moved forward, so that the disk pushing member 55 projects into the disk-placing dented portion 54.

Accordingly, in the state where the first adapter half 1 and the second adapter half 2 are disposed in the disk-placing dented portion 54 as mentioned above, when the disk tray 53 is ejected from the printer main body 52, the disk pushing member 55 is moved backward. Consequently, the second adapter half 2 engaged with the disk pushing member 55 moves in the direction that the second adapter half 2 goes away from the first adapter half 1. In this state, a disk-disposing space S having a configuration corresponding to the card-shaped compact disk D and a size slightly larger than that of the disk D is formed between the adapter halves 1 and 2.

On the other hand, when the disk tray 53 is inserted into the printer main body 52, the disk pushing member 55 is moved forward. Consequently, the second adapter half 2 engaged with the disk pushing member 55 moves in the direction that the second adapter half 2 approaches the first adapter half 1.

Furthermore, each disk contact portion 10*b*, 11*d*, 20*a* and 22*b* formed on the inner periphery of the adapter halves 1 and 2 has a disk-guiding wall portion inclined inwardly and downwardly, so that a disk D can be easily disposed in the disk-disposing space S. Furthermore, each disk contact portion 10*b*, 11*d*, 20*a* and 22*b* has a vertical wall portion as shown in FIGS. 2B, 2C, 3B and 3C.

When using the aforementioned disk adapter A of this embodiment, as shown in FIG. 4, the first adapter half 2 is disposed at the front end portion in the disk-placing denied portion 54 with the engaging protrusions 10*a* and 10*a* engaged with the die-releasing holes 57 and 57 of the disk-placing dented portion 54. Then, the second adapter half 2 is disposed at the rear end portion in the disk-placing dented portion 54 such that L-shaped engaging portion 21*a* of the second adapter half 2 is engaged with the L-shaped engaging cutout portion 11*c* of the first adapter half 1 and that the projection 55*a* of the disk pushing member 55 is engaged with the gap 24, Thereby, the disposing the disk adapter A to the disk tray 53 is completed.

Thereafter, a disk D is set in the disk-disposing space S formed between the first adapter half 1 and the second adapter half 2. Then, the disk tray 53 is inserted into the printer main body 51. Then, the disk pushing member 55 moves forward in accordance with the movement of the disk tray 53, thereby pushing the second adapter half 2 against the disk D. Accordingly, the disk D is immovably held in the disk-placing dented portion 54. Label printing is performed in this holding state.

When the disk tray 53 is ejected from the printer main body 51 after the completion of the label printing, the disk pushing member 55 moves backward from the second adapter half holding position, thereby releasing the restricted state of the disk D. Accordingly, the printed disk D can be taken out easily.

Figure 6:
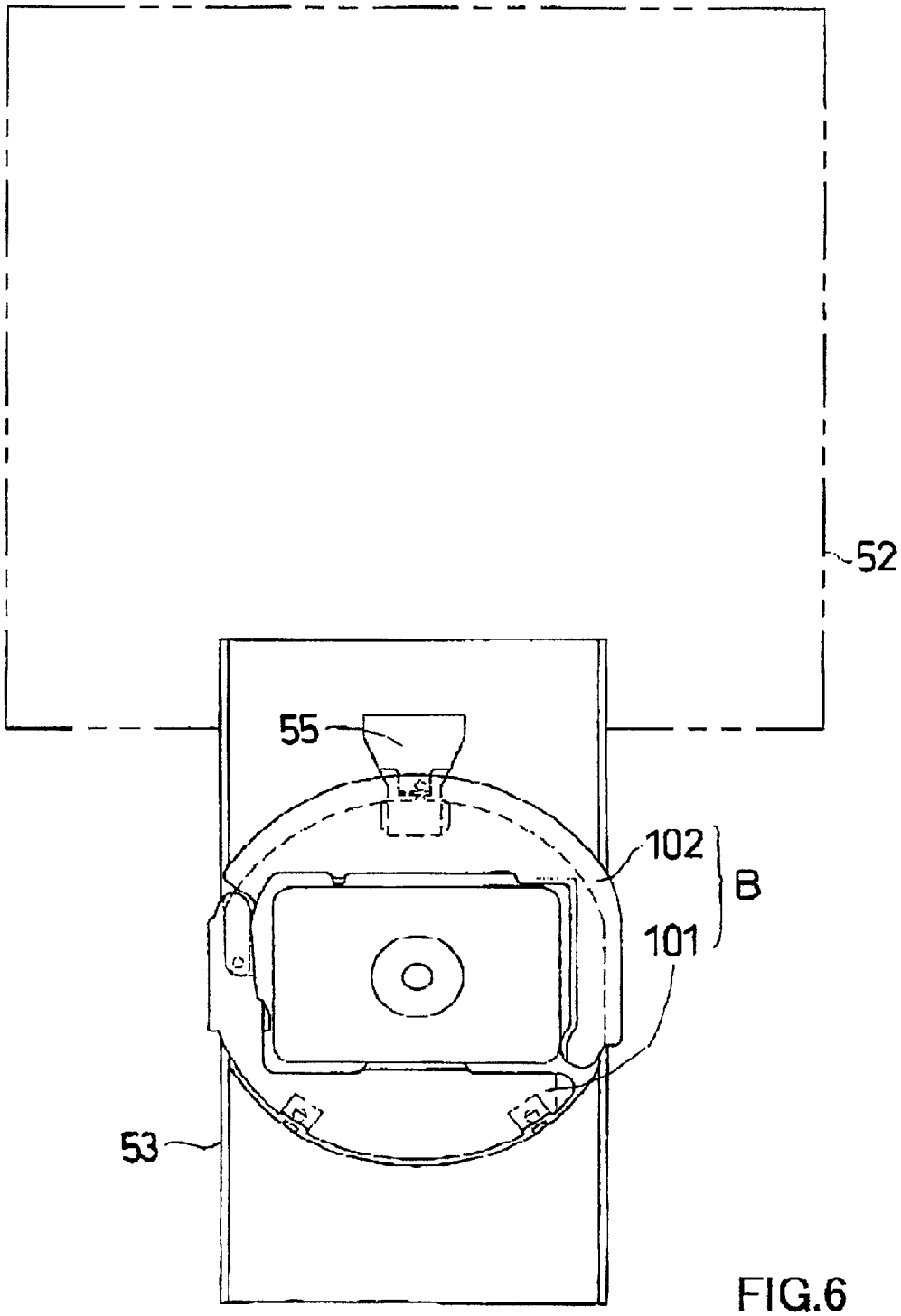
FIG. 6 is a plane view showing the disk tray ejected from the printer main body and the disk adapter disposed on the disk tray according to the second embodiment.
Figure 7A:
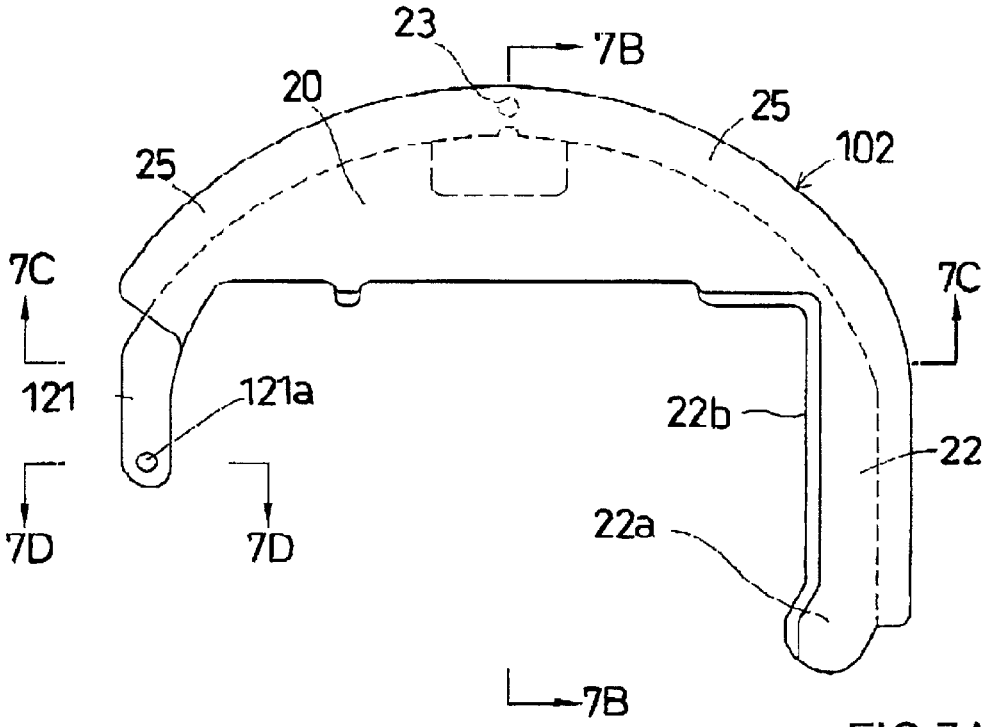
FIG. 7A is a plane view showing the second adapter half of the disk adapter.
Figure 7B:
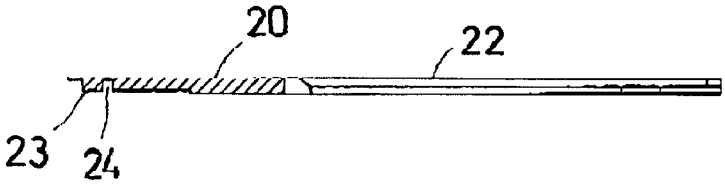
FIG. 7B is a cross-sectional view taken along the line 7B—7B in FIG. 7A.
Figure 7C:
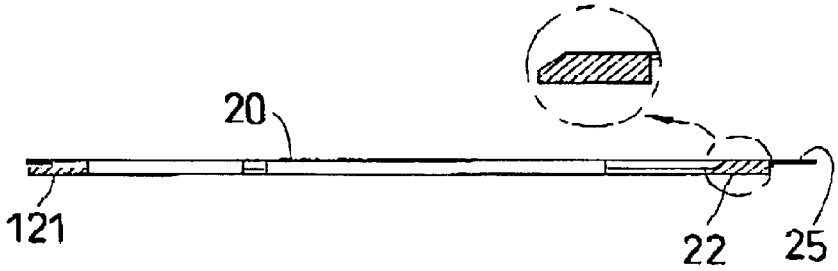
FIG. 7C is a cross-sectional view taken along the line 7C—7C in FIG. 7A.
Figure 7D:
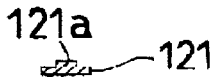
FIG. 7D is a cross-sectional view taken along the line 7D—7D in FIG. 7A.
Figure 8A:
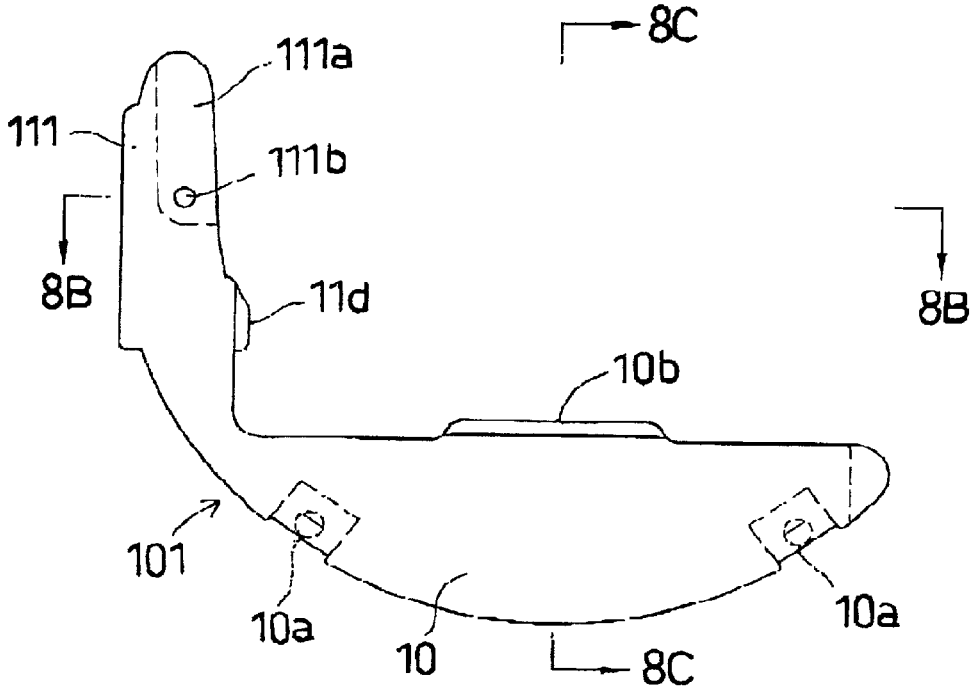
FIG. 8A is a plane view showing the first adapter half of the disk adapter.
Figure 8B:
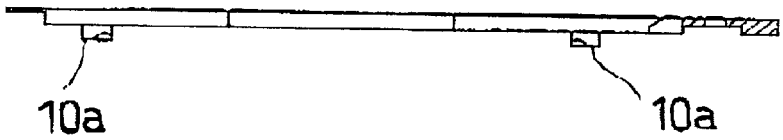
FIG. 8B is a cross-sectional view taken along the line 8B—8B in FIG. 8A.
Figure 8C:
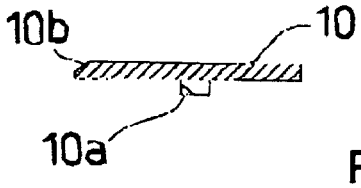
FIG. 8C is a cross-sectional view taken along the 8C—8C in FIG. 8A.

FIGS. 6 to 8 show a disk adapter B according to the second embodiment.

This disk adapter B consists of a first adapter half 101 and a second adapter half 102. Although the first and second adapter halves 101 and 102 are the same as the first and second adapter halves 1 and 2 in fundamental structure, but differ in connection structure. Accordingly, the detail explanation will be omitted by allotting the same reference numeral to the corresponding portion.

As shown in FIG. 8A, the connecting portion 111 of the first adapter half 101 has an elongated dented portion 111*a* extending in the longitudinal direction of the connecting portion 111 at the lower surface of the tip end portion and an engaging hole 111*b* formed at the basal end of the dented portion 111*a*.

On the other hand, the connecting portion 121 of the second adapter half 102 is formed to have a narrow width corresponding to the width of the dented portion 111*a* of the first adapter half 101. At the tip end of the connecting portion 121, an engaging protrusion 121*a* to be engaged with the engaging hole 111*b* of the connecting portion 111 of the first adapter half 101 is formed.

These adapter halves 101 and 102 are disposed on the disk tray 53 with the engaging protrusion 121*a* engaged with the engaging hole 111*b*. The operation and functions thereof are the same as the first embodiment.

In this adapter B, a disk D is set in the disk-disposing space S formed between the first adapter half 101 and the second adapter half 102. Then, the disk tray 53 is inserted into the printer main body 51. Then, the disk pushing member 55 moves forward in accordance with the movement of the disk tray 53, so that the second adapter half 102 rotates toward the first adapter half 101 about the engaging portion of the engaging protrusion 121*a* and the engaging hole 111*b* has a fulcrum, thereby pushing the second adapter half 102 against the disk D. Accordingly, the disk D is immovably held in the disk-placing dented portion 54. Thus, label printing is performed in this holding state. When the disk tray 53 is ejected from the printer main body 51 after the completion of the label printing, the disk pushing member 55 moves backward from the second adapter half holding position, so that the second adapter half 102 rotates about the engaging protrusion 121*a* as a fulcrum, thereby releasing the restricted state of the disk D. Accordingly, the printed disk D can be taken out easily.

FIGS. 9 to 13 show the third embodiment according to the present invention.

Figure 9:
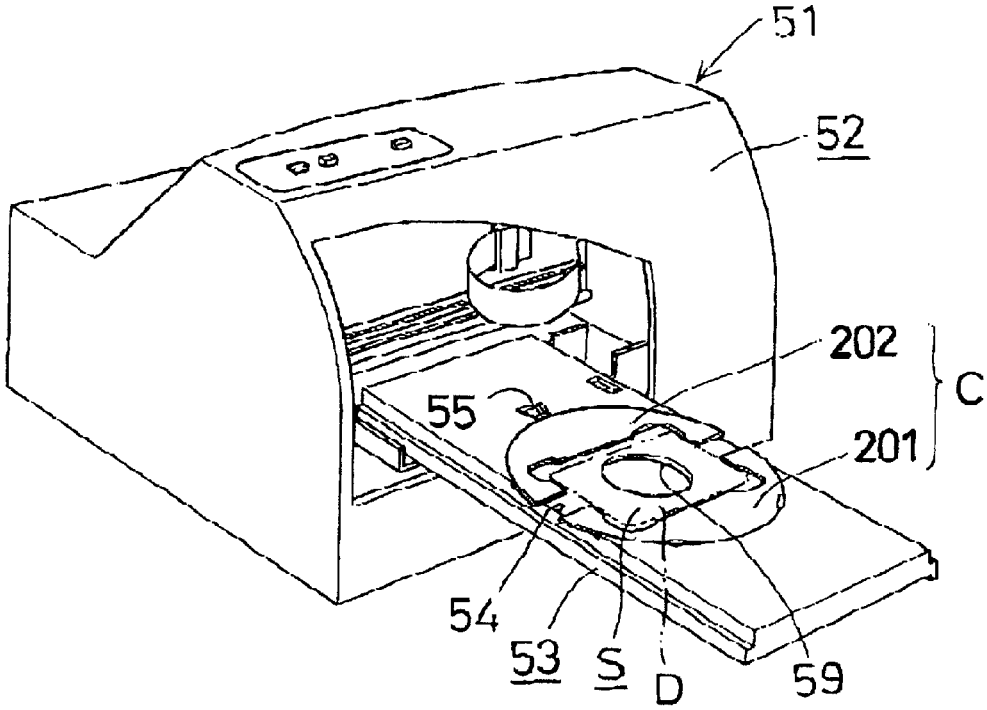
FIG. 9 is a perspective view showing the state where the disk adapter according to the third embodiment of the present invention is disposed in a disk tray of a label printer.

FIG. 9 is a perspective view showing the state that a disk adapter C according to the third embodiment of the present invention is disposed on the disk tray 53 of the label printer 51. This disk adapter C is designed as an adapter for card-shape compact disks D.

Figure 10A:
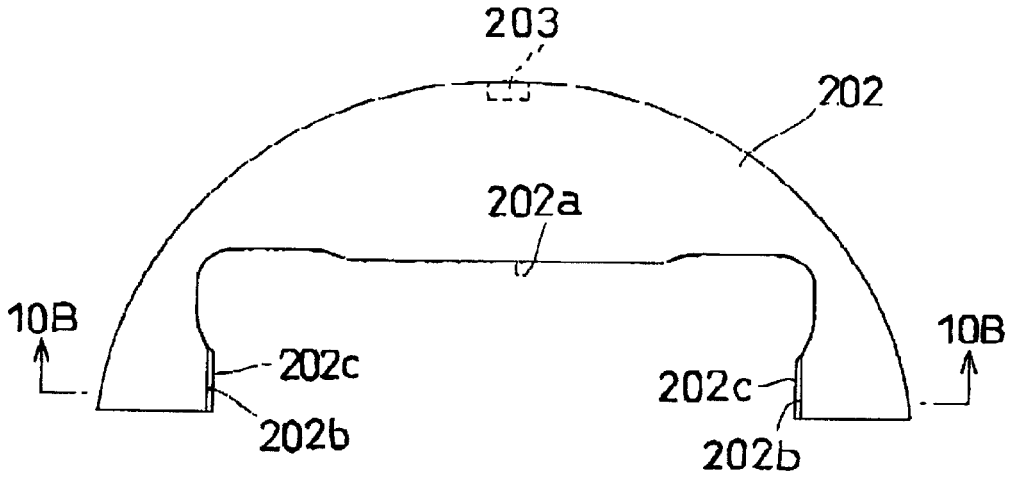
FIG. 10A is a plane view showing the second adapter half of the disk adapter.
Figure 10B:
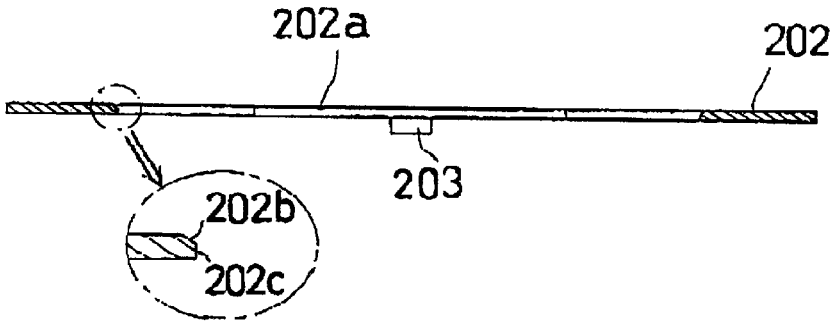
FIG. 10B is a cross-sectional view taken along the line 10B—10B in FIG. 10A.
Figure 11A:
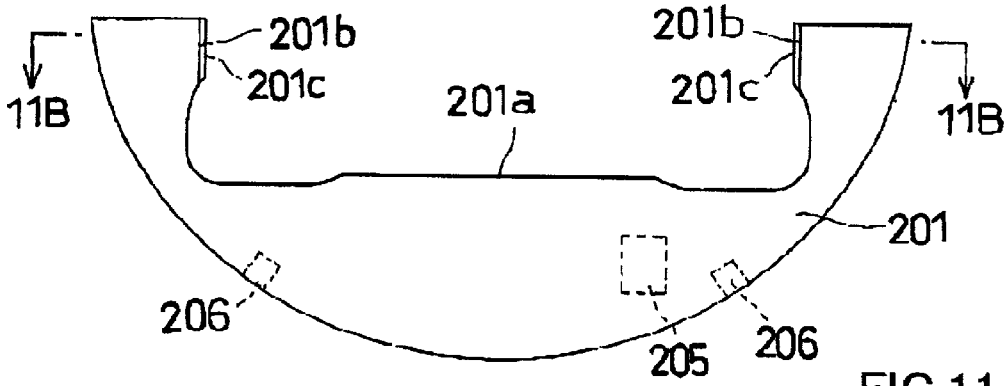
FIG. 11A is a plane view showing the first adapter half of the disk adapter.
Figure 11B:
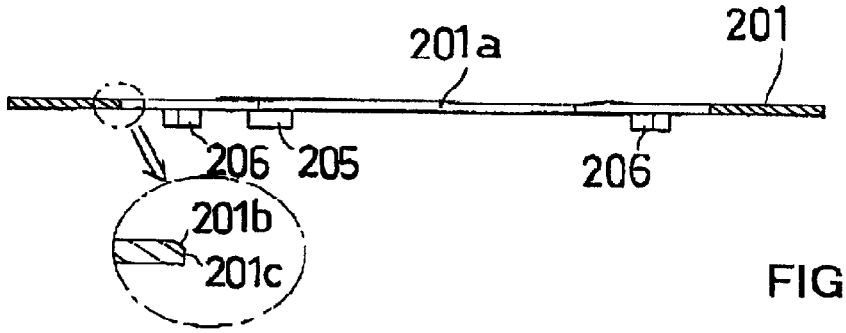
FIG. 11B is a cross-sectional view taken along the line 11B—11B in FIG. 11A.

As shown in FIGS. 10A and 11A, this disk adapter C consists of a first adapter half 201 and a second adapter half 202 which are generally the same in size and symmetry in shape. Each adapter half 201 and 202 has an arch-shaped semicircular configuration. The peripheral arc-shaped portion thereof is set to have a radius curvature corresponding to the inner edge of the disk-placing dented portion 54 of the disk tray 53. The first adapter half 201 shown in FIG. 11A is to be disposed at the front end portion in the disk-placing dented portion 54 of the disk tray 53, and has three downwardly protruded engaging protrusions 205, 206 and 206. One of the engaging protrusions 205 engages with the sensor aperture 58 provided in the disk-placing dented portion 54, and the other two engaging protrusions 206 and 206 engage with die-releasing holes 57 and 57. These engaging protrusions engage with the sensor aperture 58 and the die-releasing holes 57 and 57 respectively, so that the first adapter half 202 is detachably fixed to the front end potion in the disk-placing dented portion 54 of the disk tray 53.

The second adapter half 202 shown in FIG. 10A is to be detachably disposed in the rear end portion in the disk-placing dented portion 54 of the disk tray 53, and is provided with a protrusion 203 consisting of a magnet at a portion of the lower surface corresponding to an iron pushing portion 55*a* of the disk pushing member 55 provided on the disk tray 53. Accordingly, this second adapter half 202 is pushed by the iron pushing portion 55*a* toward the first adapter half 201 in accordance with the forward movement of the iron pushing portion 55*a*. Furthermore, the second adapter half 202 is moved backward, i.e., toward the rear end of the disk-placing dented portion 54 in accordance with the backward movement of the iron pushing portion 55*a*. These adapter halves 201 and 202 form a disk-disposing space S larger than the card-shaped compact disk D between both the adapter halves 201 and 202 in a state that these adapter halves are disposed at the predetermined position of the disk-disposing dented portion 54. Furthermore, the portion of the inner periphery of the adapter halves 201 and 202 corresponding to the shorter edge of the card-shaped compact disk D is formed to have a disk guiding inclined wall surface 201*b*, 201*b*, 202*b* and 202*b*, so that the disk D can be easily disposed in the disk-disposing space S. The lower portion below the disk guiding inclined wall surface 201*b*, 201*b*, 202*b* and 202*b* is formed to be a vertical wall surface 201*c*, 201*c*, 202*c* and 202*c*. The distance between the opposite wall surfaces is set to be slightly larger than the length of the card-shaped compact disk.

Figure 12:
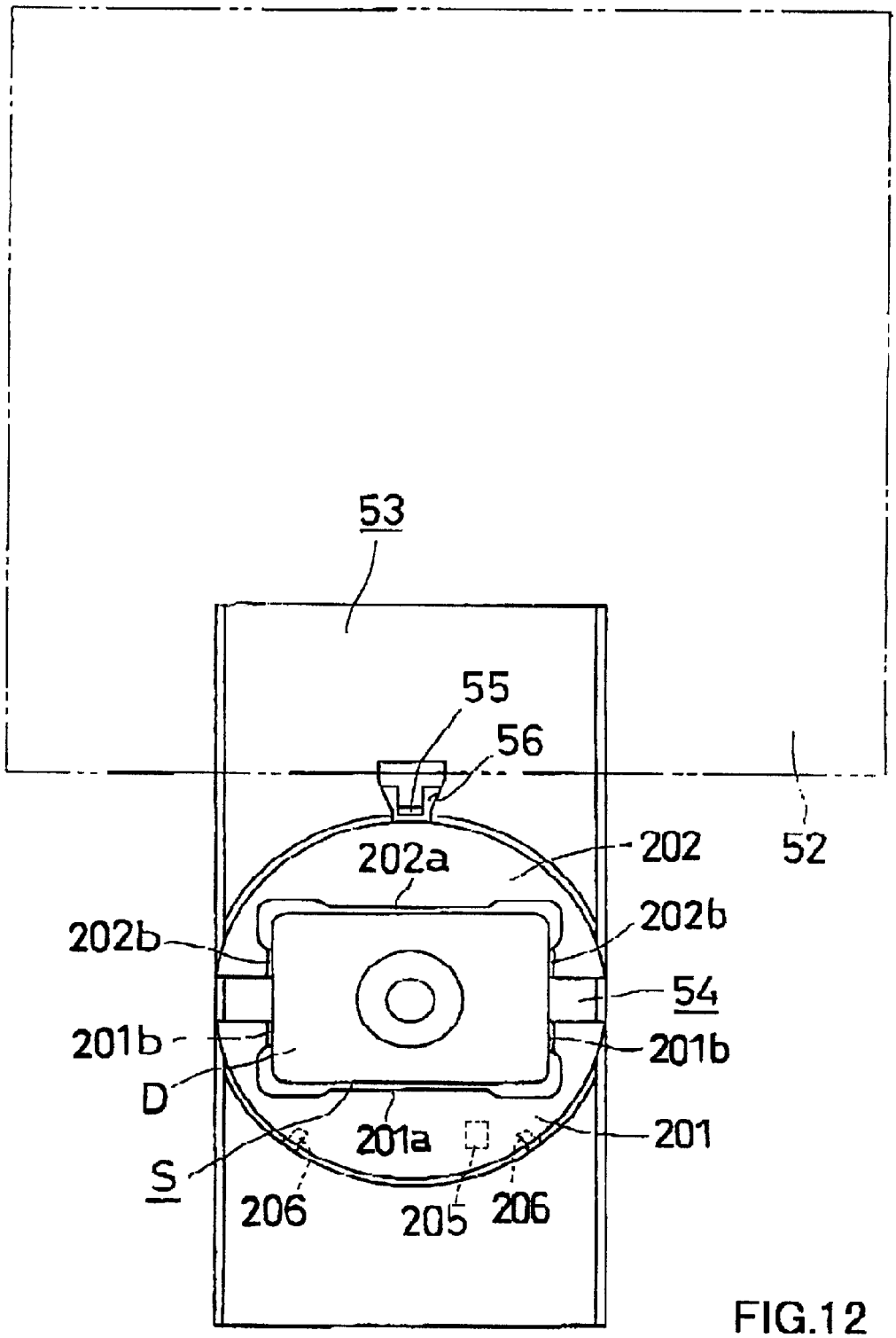
FIG. 12 is a plane view showing the disk tray ejected from the printer main body and the disk adapter disposed on the disk tray according to the third embodiment.
Figure 13:
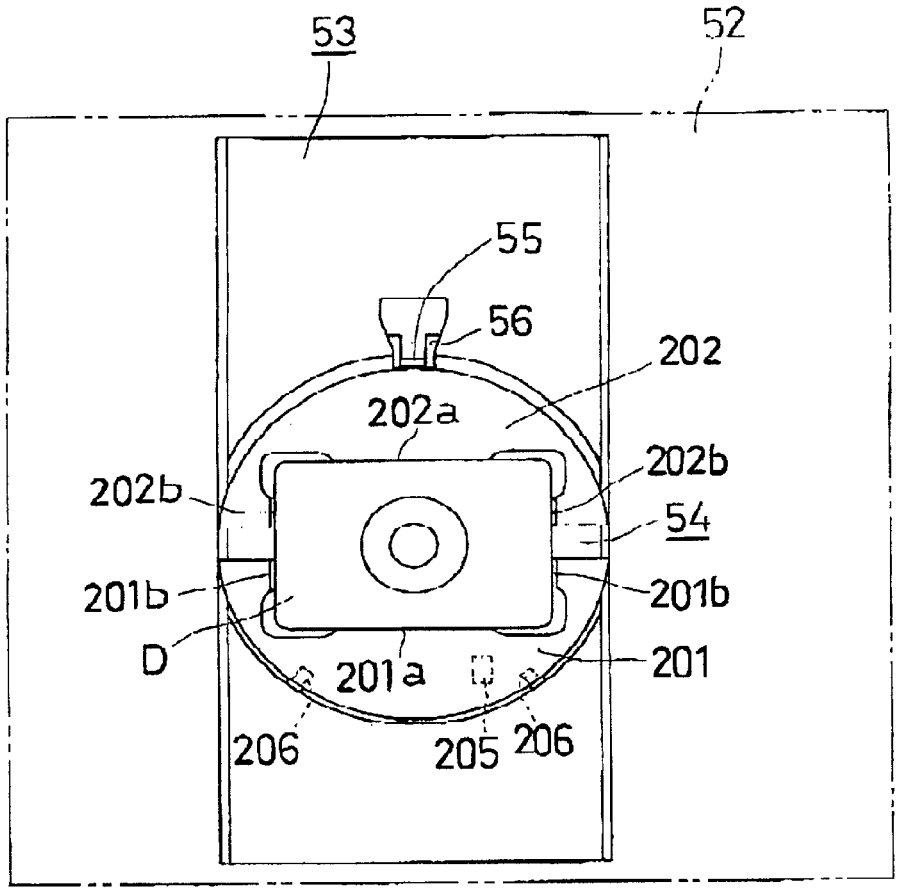
FIG. 13 is a plane view showing the disk tray inserted in the printer main body and the disk adapter disposed on the disk tray according to the third embodiment.

When using the aforementioned disk adapter C of this embodiment, as shown in FIG. 12, the first adapter half 201 is disposed in the front and portion of the disk-placing dented portion 54 with the engaging protrusions 205, 206 and 206 engaged with the sensor aperture 58 and the die-releasing holes 57 and 57 of the disk-placing dented portion 54. Then, the second adapter half 202 is disposed at the rear end portion in the disk-placing dented portion 54 such that the protrusion 203 coincides with the disk pushing member 55 of the disk tray 53. Thereby, the disposing the disk adapter C to the disk tray 53 is completed.

Thereafter, a disk D is set in the disk-disposing space S formed between the first adapter half 201 and the second adapter half 202. Then, the disk tray 53 is inserted into the printer main body 51. Then, the disk pushing member 55 moves forward in accordance with the movement of the disk tray 53, thereby pushing the second adapter half 202 against the disk D. Accordingly, the disk D is immovably held in the disk-placing dented portion 54. Thus, label printing is performed in this holding state. When the disk tray 53 is ejected from the printer main body 51 after the completion of the label printing, the disk pushing member 55 moves backward from the second adapter half holding position, thereby releasing the restricted state of the disk D.

Figure 14:
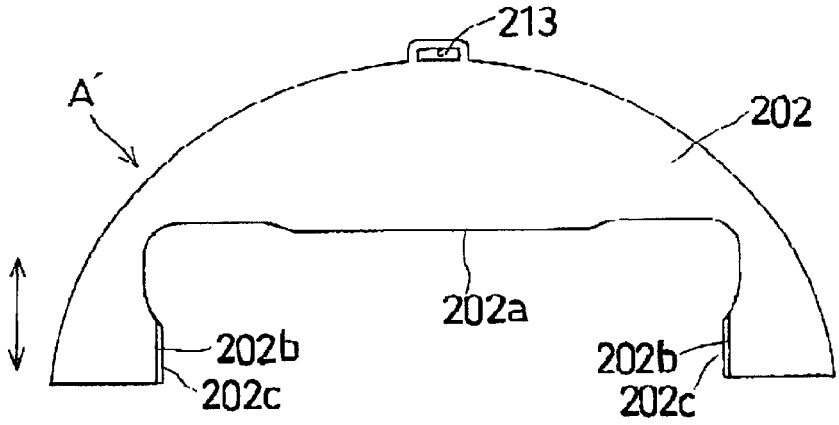
FIG. 14 is a plane view showing a modification of the second adapter half of the third embodiment.

FIG. 14 shows a modification of the second adapter half 202. This second adapter half 202 is provided with a backwardly protruded engaging portion having an engaging hole 213 at the portion corresponding to the disk pushing member 55. The second adapter half 202 moves in the disk-placing dented portion 54 in accordance with the movement of the disk pushing member 55 with the disk pushing member 55 engaged with the engaging hole 213. Since the other structures are the same as those of the third embodiment, the explanation will be omitted by allotting the same reference numeral to the corresponding portion.

Figure 15:
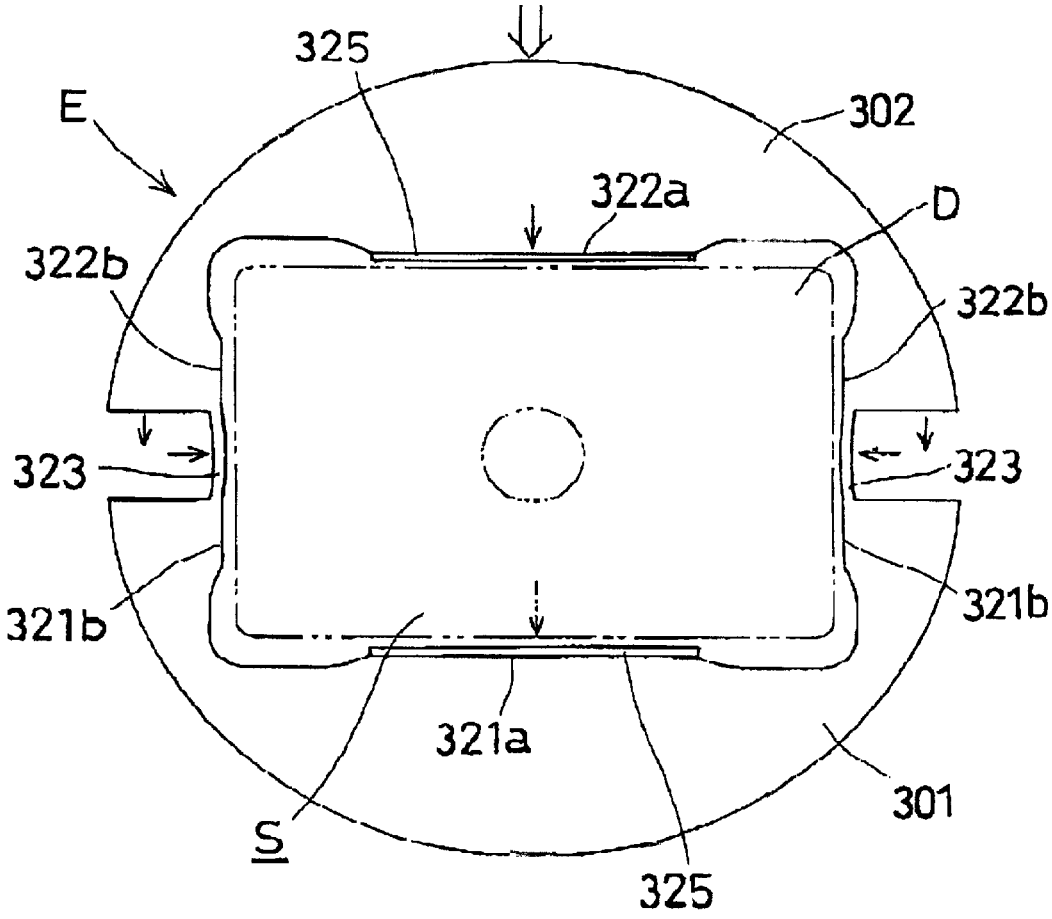
FIG. 15 is a plane view showing a disk adapter according to the fourth embodiment.

FIG. 15 shows a plane view showing the disk adapter E according to the fourth embodiment.

This disk adapter E includes a first adapter half 301 and a second adapter half 302 connected by connecting portions 323 and 323, and is made from synthetic resin comparatively rich in elasticity Accordingly, in the state that a compact disk D is placed on the disk tray, when the disk adapter E is pressed by the disk pushing member 55 in the direction of the arrow shown, the second adapter half 302 moves in the direction that the second adapter half presses the disk D and the connecting portions 323 and 323 inwardly bend, resulting in secure holding of the disk D. On the other hand, when the pressing force by the disk pushing member 55 is released, the second adapter half 302 returns to its original position by the elastic resilience of the connecting members 323 and 323.

Furthermore, at the portions of the first adapter half 301 and the second adapter half 302 to which the periphery of the disk D contacts, a thin member 325 rich in elastic resilience such as rubber and sponge is integrally provided. Accordingly, the adapter D can be used for various disks slightly different in size, resulting in an increased tolerance.

According to the present invention, in a state where the disk tray is inserted into the printer main body, since one of the adapter halves is moved by the disk pushing member so as to approach the other adapter half to hold the optical disk by and between both the adapter halves, an unexpected movement of the disk does not occur at the time of the label printing. Accordingly, printing to a predetermined printing position can be performed assuredly. Furthermore, when the disk tray is inserted into the printer main body with a disk disposed in the disk-disposing space between the adapter halves, the disk is automatically held. Accordingly, it becomes unnecessary to perform operation for fixing the disk to and releasing it from a disk adapter which were required in a conventional adapter.

In cases where the first adapter half and the second adapter half is be rotatably connected at one side thereof so that the second adapter half can be pivoted on the one side as a fulcrum in accordance with a forward/backward movement of the disk pushing member, when the second adapter half rotates about the side portion as a fulcrum in accordance with the forward/backward movement of the disk pushing member, the disk is held by and between the adapters halves or released from the adapter halves.

In cases where the second adapter half is moved in a longitudinal direction of the disk tray in accordance with the forward/backward movement of the disk pushing member, when the second adapter half is moved in a longitudinal direction of the disk tray in accordance with the forward/backward movement of the disk pushing member, the disk is held by and between the adapters halves or released from the adapter halves.

In cases where the first adapter half is equipped with fixing members for detachably fixing the first adapter half in the disk-placing dented portion, since it is only required to move the second adapter half, a disk adapter for optical disk label printers excellent in operability can be provided.

In cases where a downwardly protruded member is provided as fixing means, the fixing member can be formed at the time of manufacturing the first adapter half.

In cases where the second adapter half is equipped with a connecting portion for connecting the second adapter half to the disk pushing member, since the second adapter half and the disk pushing member are connected each other by the connecting portion, the second adapter half is moved relative to the first adapter half in accordance with the forward/backward movement of the disk pushing member.

In cases where the connecting portion of the second adapter half is magnetically connected to the disk pushing member, the first adapter half is moved relative to the second adapter half in accordance with the forward/backward movement of the disk pushing member, and the operation for connecting the second adapter half to the disk pushing member and disconnecting the second adapter half from the disk pushing member can be performed easily and assuredly, resulting in enhanced operability.

In cases where the first adapter half and the second adapter half are integrally connected via an elastic connecting member, in a state where the disk tray is ejected from the printer main body, one of the adapter halves is moved so as to go away from the second adapter half due to the backward movement of the disk pushing member and the elastic resiliency of the connecting member. Accordingly, an optical disk-disposing space can be secured easily and assuredly between the adapter halves.

Furthermore, in cases where the first adapter half and the second adapter half have a slanted inner periphery, respectively, since a disk is guided by the slanted inner periphery at the time of disposing the disk in the disk-disposing space between the first and second adapters, the disposing can be carried out easily and assuredly. Especially, in cases where a disk is disposed in the disk-disposing space with a machine such as a hand arm, a preferable disk adapter for optical disk label printers can be provided.

Furthermore, in cases where the disk-disposing space is set to have a configuration and a size corresponding to those of a card-shaped optical disk, it becomes possible to perform printing to the card-shaped optical disk.

The disk adapter according to the present invention is not limited to the disk adapter for the card-shaped disk, and can be adapted not only to an 8 cm-CD but also to various non-standard size/shapes CD other than the card-shaped CD by changing the configuration of the first adapter half, the second adapter half and/or the disk-disposing space.

Lastly, in cases where a thin member rich in elasticity is attached to the disk periphery contact portion of the adapter halves, a disk can be hold by and between the adapter halves more assuredly.

This application claims priority to Japanese Patent Application No. 2001-35873 filed on Feb. 13, 2001, the disclosure of which is incorporated by reference in its entirety.

The terms and descriptions in this specification are used only for explanatory purpose and the present invention is not limited to these terms and descriptions. It should be appreciated that there are many modifications and substitutions without departing from the spirit and the scope of the present invention which is defined by the appended claims. A present invention permits any design-change, unless it deviates from the soul, if it is within the limits by which the claim was performed.

What is claimed is:

1. A disk adapter attached to an optical disk label printer for adapting a disk tray that can be ejected from and inserted into a printer main body, comprising:

a first adapter half configured to be detachably placed in a front portion of a disk-placing portion; and a second adapter half configured to be detachably placed in a rear portion of the disk-placing portion, wherein one of said adapter halves is movable relative to the other adapter half in accordance with a movement of a disk pushing member, wherein, in a state where the disk tray is ejected from the printer main body, said one of said adapter halves is moved by the disk pushing member in a direction that said one of said adapter halves goes away from said the other adapter half, whereby a disk-disposing space is formed between said adapter halves, and wherein, in a state where the disk tray is inserted into the printer main body, said one of adapter halves is moved by the disk pushing member in a direction that said one of adapter halves approaches said the other adapter half, whereby the optical disk is held by and between said adapter halves.

2. The disk adapter attached to an optical disk label printer as recited in claim 1, wherein said first adapter half and said second adapter half are pivotably connected at one side thereof, and wherein said second adapter half is pivoted on said one side as a fulcrum in accordance with a forward/backward movement of said disk pushing member.

3. The disk adapter attached to an optical disk label printer as recited in claim 2, wherein said first adapter half is equipped with fixing members for detachably fixing said first adapter half in a disk-placing dented portion.

4. The disk adapter attached to an optical disk label printer as recited in claim 3, wherein said fixing member is a downwardly protruded member.

5. The disk adapter attached to an optical disk label printer as recited in claim 2, wherein said disk-disposing space is set to have a configuration and a size corresponding to those of a card-shaped optical disk.

6. The disk adapter attached to an optical disk label printer as recited in claim 5, wherein said card-shaped optical disk is generally rectangular.

7. The disk adapter attached to an optical disk label printer as recited in claim 1, wherein said second adapter half is moved in a longitudinal direction of the disk tray in accordance with the forward/backward movement of the disk pushing member.

8. The disk adapter attached to an optical disk label printer as recited in claim 7, wherein said first adapter half is equipped with fixing members for detachably fixing said first adapter half in a disk-placing dented portion.

9. The disk adapter attached to an optical disk label printer as recited in claim 8, wherein said fixing member is a downwardly protruded member.

10. The disk adapter attached to an optical disk label printer as recited in claim 7, wherein said first adapter half and said second adapter half are integrally connected via an elastic connecting member.

11. The disk adapter attached to an optical disk label printer as recited in claim 7, wherein said disk-disposing space is set to have a configuration and a size corresponding to those of a card-shaped optical disk.

12. The disk adapter attached to an optical disk label printer as recited in claim 11, wherein said card-shaped optical disk is generally rectangular.

13. The disk adapter attached to an optical disk label printer as recited in claim 1, wherein said first adapter half is equipped with fixing members for detachably fixing said first adapter half in a disk-placing dented portion.

14. The disk adapter attached to an optical disk label printer as recited in claim 13, wherein said fixing member is a downwardly protruded member.

15. The disk adapter attached to an optical disk label printer as recited in claim 1, wherein said second adapter half is equipped with a connecting portion for connecting said second adapter half to the disk pushing member.

16. The disk adapter attached to an optical disk label printer as recited in claim 15, wherein said connecting portion of said second adapter half is magnetically connected to the disk pushing member.

17. The disk adapter attached to an optical disk label printer as recited in claim 1, wherein said first adapter half and said second adapter half are integrally connected via an elastic connecting member.

18. The disk adapter attached to an optical disk label printer as recited in claim 1, wherein said first adapter half and said second adapter half have a slanted inner periphery, respectively.

19. The disk adapter attached to an optical disk label printer as recited in claim 1, wherein said disk-disposing space is set to have a configuration and a size corresponding to those of a card-shaped optical disk.

20. The disk adapter attached to an optical disk label printer as recited in claim 19, wherein said card-shaped optical disk is generally rectangular.

21. A disk adapter attached to an optical disk label printer for adapting a disk tray that can be ejected from and inserted into a printer main body, comprising:

a first adapter half configured to be detachably placed in a front portion of a disk-placing portion; and a second adapter half configured to be detachably placed in a rear portion of the disk-placing portion, wherein said first adapter half and said second adapter half are pivotably connected at one side thereof, wherein said second adapter half is rotated about said one side as a fulcrum in accordance with a forward/backward movement of a disk pushing member, wherein, in a state where the disk tray is ejected from the printer main body, said second adapter half is rotated by the disk pushing member so that said second adapter half goes away from said first adapter half, whereby a disk-disposing space is formed between said adapter halves, and wherein, in a state where the disk tray is inserted into the printer main body, said second adapter half is rotated by the disk pushing member so that said second adapter half approaches said first adapter half, whereby the optical disk is held by and between said adapter halves.

22. A disk adapter, comprising:

a first adapter half having means for being detachably placed in a front portion of a disk-placing portion of a disk tray of a printer main body of an optical disk label printer; and a second adapter half having means for being detachably placed in a rear portion of the disk-placing portion, wherein one of said adapter halves includes means for moving relative to the other adapter half in accordance with a movement of a disk pushing member, so that in a state where the disk tray is ejected from the printer main body, said one of said adapter halves is moved by the disk pushing member in a direction that said one of said adapter halves goes away from said the other adapter half, whereby a disk-disposing space is formed between said adapter halves, and that in a state where the disk tray is inserted into the printer main body, said one of adapter halves is moved by the disk pushing member in a direction that said one of adapter halves approaches said the other adapter half, whereby the optical disk is held by and between said adapter halves.

23. The disk adapter according to claim 22, wherein said disk adapter is attached to an optical disk label printer.

24. A method, comprising:

a) providing a disk adapter attachable to an optical disk device equipped with a disk tray having a disk placing portion, the disk tray being mounted to a device main body in such a manner that the disk tray can be ejected from and inserted into the main body, the disk adapter comprising:

a first adapter half to be detachably placed in a front portion of the disk-placing portion; and a second adapter half to be detachably placed in a rear portion of the disk-placing portion, wherein one of said adapter halves is movable relative to the other adapter half;

b) ejecting the disk tray from the main body such that one of said adapter halves is moved in a direction that said one of said adapter halves goes away from said the other adapter half, whereby a disk-disposing space is formed between said adapter halves, and c) inserting the disk tray into the main body such that one of adapter halves is moved in a direction that said one of adapter halves approaches said the other adapter half, whereby the optical disk is held by and between said adapter halves.

25. The method of claim according to claim 24, wherein said optical disk device is an optical disk label printer.

* * * * *